US009163395B2

(12) United States Patent
Finney

(10) Patent No.: US 9,163,395 B2
(45) Date of Patent: Oct. 20, 2015

(54) COMPACT COMBINED HABITATION MODULE AND UTILITY RACK WITH MULTIPLE DEPLOYMENT MODES

(71) Applicant: Taxa, Inc., Houston, TX (US)

(72) Inventor: Garrett Stevens Finney, Houston, TX (US)

(73) Assignee: TAXA, INC., Houston, TX (US)

( * ) Notice: Subject to any disclaimer, the term of this patent is extended or adjusted under 35 U.S.C. 154(b) by 0 days.

(21) Appl. No.: 14/338,387

(22) Filed: Jul. 23, 2014

(65) Prior Publication Data

US 2015/0027067 A1 Jan. 29, 2015

Related U.S. Application Data

(60) Provisional application No. 61/857,765, filed on Jul. 24, 2013.

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |
| ***E04B 1/343*** | (2006.01) |
| ***E04H 1/12*** | (2006.01) |

(52) U.S. Cl.

CPC ..... *E04B 1/34363* (2013.01); *E04B 1/34336* (2013.01); *E04H 1/12* (2013.01); *E04H 1/1205* (2013.01); *E04H 9/00* (2013.01)

(58) Field of Classification Search

CPC ..... E04H 1/1205; E04H 9/14; E04H 1/02; E04H 1/12; E04H 9/00; E04H 1/1211; E04H 1/1216; E04H 1/1222; E04H 1/1227; E04H 1/1233; E04H 1/1238; E04H 1/1244; E04B 1/34321; E04B 1/34807; E04B 1/34336; E04B 1/34363

USPC ..... 52/79.1, 79.4, 79.5, 79.7, 36.2, 143; 296/165, 168, 173, 181.7, 193.03, 296/193.04

See application file for complete search history.

(56) References Cited

U.S. PATENT DOCUMENTS

| | | | | |
|---|---|---|---|---|
| 3,652,119 | A * | 3/1972 | Hall | 296/164 |
| 5,755,062 | A * | 5/1998 | Slater | 52/79.1 |
| 6,155,279 | A * | 12/2000 | Humphrey | 135/87 |
| 6,282,848 | B1 * | 9/2001 | Schlapfer | 52/79.1 |
| 6,283,536 | B1 * | 9/2001 | Muzyka et al. | 296/165 |

(Continued)

*Primary Examiner* — Brian D Mattei

(74) *Attorney, Agent, or Firm* — Husch Blackwell LLP

(57) ABSTRACT

The present invention is an easily mobilized compact module that combines habitable quarters and integrated interior and/or exterior multipurpose storage structures. Mobilization may be via trailer, truck bed, helicopter, adjustable jacks or other conveyance means. The module may be easily and quickly removed and reattached to one of the aforementioned mobilization means via attachable height-adjustable legs, hoist, crane, or forklift with locking turnbuckles, bolts, or other hold-downs. The module is built of a rigid exoskeleton designed for enclosure habitat and for utility as a base for attaching items or equipment. It has various end cap options such as doors, windows, or solid panels, as a user dictates. The interior of a module has modular panels that form many configurations for functional use and/or storage. The interior also has a useful endoskeleton or useful interior storage structure for attaching useful items such as soft stowage and electrical wires thereto. The module may be used as a single unit or attached together to form a larger habitable structure.

20 Claims, 7 Drawing Sheets

(56) References Cited

U.S. PATENT DOCUMENTS

| | | | | |
|---|---|---|---|---|
| 6,550,216 | B1 * | 4/2003 | Ohanesian | 52/783.11 |
| D661,229 | S * | 6/2012 | O'Neill | D12/102 |
| 2002/0194796 | A1 * | 12/2002 | Kress | 52/79.1 |
| 2004/0177568 | A1 * | 9/2004 | Hanks | 52/79.1 |
| 2005/0235819 | A1 * | 10/2005 | Long | 89/36.07 |
| 2010/0024317 | A1 * | 2/2010 | Pope | 52/79.5 |
| 2010/0088974 | A1 * | 4/2010 | Scott, IV | 52/79.5 |
| 2011/0209418 | A1 * | 9/2011 | Drake | 52/79.5 |

* cited by examiner

COMPACT COMBINED HABITATION MODULE AND UTILITY RACK WITH MULTIPLE DEPLOYMENT MODES

CROSS-REFERENCE TO RELATED APPLICATIONS

The present invention claims the benefit of U.S. Provisional Patent Application No. 61/857,765 for COMPACT COMBINED HABITATION MODULE AND UTILITY RACK WITH MULTIPLE DEPLOYMENT MODES, filed on Jul. 24, 2013.

BACKGROUND OF INVENTION

This invention relates generally to a portable or mobile habitation module. More specifically, the present invention relates to a mobile habitation module that may also secure gear on or within the mobile habitation module.

Many people spend time in the outdoors to enjoy recreational activities such as camping, hiking, and fishing. Habitable temporary shelters such as camping trailers or vans including habitable space are often used in order to provide a base for their activities as well as protect inhabitants from the elements of the outdoors when sleeping or otherwise utilizing shelter. Such habitable temporary shelters may have other useful purposes including by agencies such as the Department of the Interior or the Department of Defense for military purposes. Other purposes for the temporary habitable shelters may be professional such as for storm chasers, astronomers, and other professionals who may have a need to be outdoors in order to carry out professional duties. Commonly camping trailers or vans, or other habitable, temporary shelters may be used as first aid stations or field offices in urban locations. The habitable, temporary shelters may be useful, for example, to aid athletes and fans alike at various sports venues (e.g., marathoners on city streets or fans at a football stadium).

There are many small, habitable modules available on the market today, both vehicle-based and trailer-based. Many of the habitable modules on the market are hard-shell habitats that are not easily mobile. The smaller habitable modules are not capable of withstanding rugged terrain that is common when traveling to rugged or recreational areas or other regions where such habitable vehicles may be used. At the same time, the larger habitable modules may have difficulty in traversing rugged terrain. The larger habitable living modules further may not be able to be towed by smaller vehicles like cars. Moreover, habitable temporary shelters are not adaptable for different usages. Other habitable living modules presently on the market may be tall and bulky, for example recreational vehicles (RVs). As such, such habitable living modules may present clearance issues during cross-country travel, or they may present visibility issues for drivers of the vehicles.

There are also many separate products devoted to securing gear or equipment on or within a vehicle. These products, however, generally serve only to act as a storage unit, and they do not provide for living habitable space. People who use small habitable vehicles to camp and enjoy the outdoors, or even people who must be outdoors to serve professional purposes, often need a habitable space that also provides adjustable or modifiable storage for computers, monitoring devices, tools, tables, awnings, clothing, hammocks, or other useful equipment. Yet, presently, current products on the market are designed for only one mode or the other. The consumer is forced to decide, for example, on a camping trailer, truck camper, or small non-portable weatherproof unit rack or storage container. Some of the units and habitats are designed for recreational use and some for professional use. Users of both habitable vehicles and storage vehicles desire a solution module that is able to not only be habitable, but also is capable of securing gear or equipment. As it stands now, consumers are forced to decide between, for example, a camping trailer or a cargo trailer, a truck camper or a tarp, or a small non-portable weatherproof tool box or rack unit.

What is needed is a designed systematic solution that can provide outdoor enthusiasts including the military and those that rely on being in the outdoors for professional purposes with the ability to solve multiple problems, situations, and scenarios they may currently face. The solution should be a habitable space for use outdoors that should be tough enough for being transported off-road in rugged terrain, but also lightweight enough to be towed by the smallest of cars, in a truck bed, or hoisted by a helicopter or other means of transportation to be delivered to remote, emergency locations or within the confines of a city. The solution should be comfortable but still be useful to the many situations and users for which it is intended. Moreover, the solution should have the ability to be arranged and re-arranged for differing scenarios, including being fully usable as a stand alone module or in conjunction with a supportive structure such as a truck or trailer and further capable of being modular and connectable to form an even larger structure.

SUMMARY OF INVENTION

The present invention is an easily mobilized compact module that combines habitable quarters and integrated multipurpose storage racks and/or systems, wherein the storage racks and/or systems may be used in association with either the interior or exterior of the compact module. The module may be mobilized via trailer, truck bed, helicopter, boat, or other means. The module may be easily removed and reattached from the mobile platform by means of integrated legs, hoist, crane, or forklift with locking turnbuckles or bolts, or other forms of hold downs.

The module may be used in any or all seasons, and it may be used both for professional and recreational purposes. It is built of a rigid structure designed for weather enclosure and for use as a base for attaching items or equipment thereto. The module has various end configurations with doors, windows, or solid panels, as a user requires for any given situation. The interior of the module may include useful panels that form many configurations for improved human living conditions, as well as storage. The interior may make use of all surfaces for attaching useful items thereto such as hard and/or soft stowage and electrical chases for wires, and it may include integrating handholds for interior mobility.

The module comprises a rigid exoskeleton structure including insulated rigid panels, a useful interior endoskeleton, or useful interior storage structure attached to the insulated rigid panels of the walls and ceilings of the exoskeleton structure, and adjustable modular furnishing panels for various usage scenarios. The exoskeleton structure further comprises end caps at its end portions that may be variably configured, for example doors, windows, hold-downs, and attachment points for items that may be used in association with the module. The module may be lifted from the ground by adjustable legs that may be releasably attachable to the bottom portion of the module in a preferred embodiment, though the legs are not a necessary component, and the module may alternatively remain in a truck bed or other transportation means in order to serve its habitable purpose. Or in yet another alternative embodiment, the module may be placed directly on a ground surface without using legs therebetween. The roof of the module may also be configured so as to provide additional storage.

The module may be used singly, or in multiples, arrayed, deployed as a group, or bolted together to form a larger accommodation.

DETAILED DESCRIPTION

In the following detailed description of example embodiments, reference is made to the accompanying drawings that form a part hereof, and in which is shown by way of illustration specific example embodiments in which the inventive subject matter may be practiced. These embodiments are described in sufficient detail to enable those skilled in the art to practice the inventive subject matter, and it is to be understood that other embodiments may be utilized and that logical, mechanical, electrical and other changes may be made without departing from the scope of the inventive subject matter. In the Figures, the same reference number is used throughout to refer to an identical component that appears in multiple Figures.

Figure 1A:
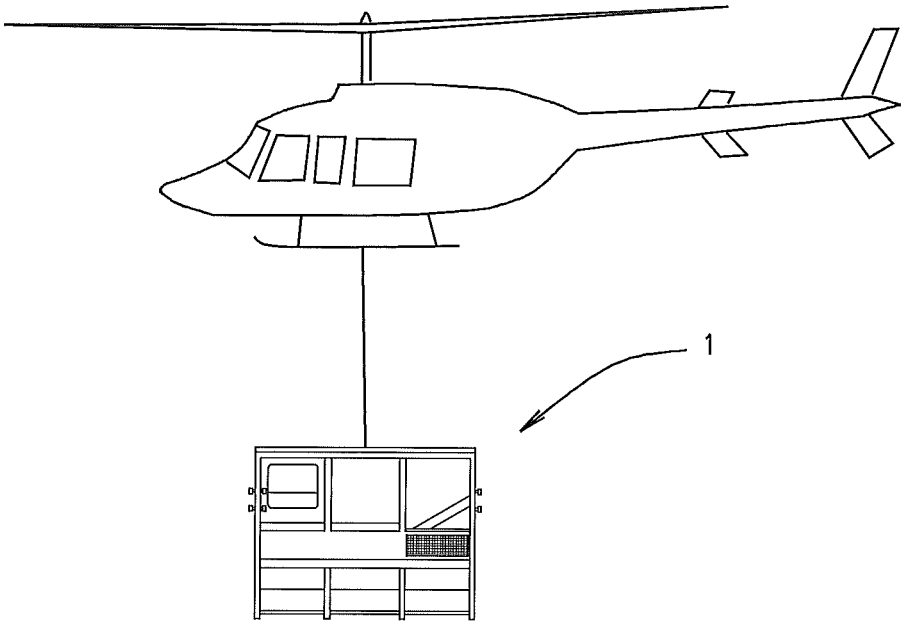
FIGS. 1A-1C illustrate various methods by which a habitation module which is constructed and assembled according to the teachings of the present invention may be delivered to a desired location.
Figure 1B:
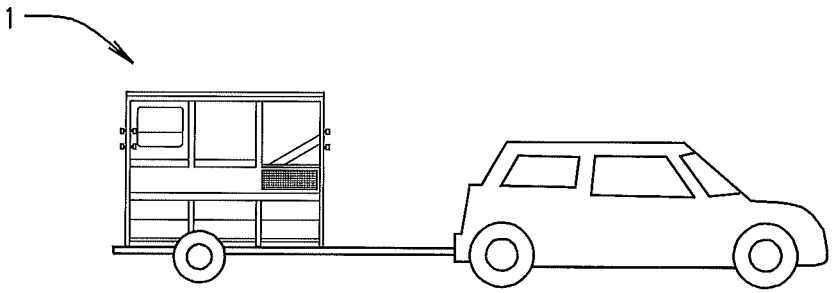
Figure 1C:
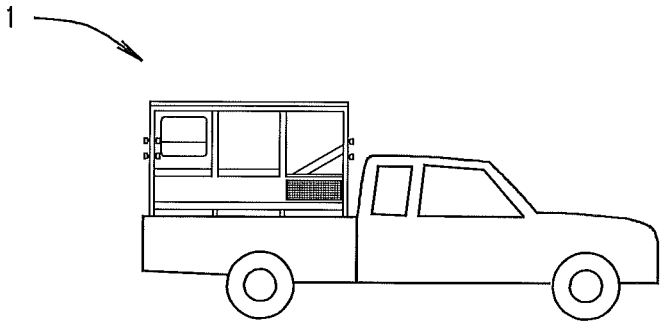

FIGS. 1A-1C illustrate various means by which a compact combined habitation module and utility rack with multiple deployment modes (referred to hereinafter as "habitation module") 1 of the present invention may be delivered to a location where it may be used as a temporary shelter for use either recreationally or professionally. Habitation module 1 may be delivered in a variety of methods. For example, as illustrated in FIG. 1A, habitation module 1 may be delivered via helicopter. This delivery method may be particularly useful in emergency scenarios where a person is stranded in a remote location and needs temporary but easily transportable shelter. Alternatively, habitation module 1 may be towed on a small trailer by a truck or car, as illustrated in FIG. 1B. In addition, habitation module 1 described herein may be contained within a truck bed, as illustrated in FIG. 1C. As FIGS. 1A-1C illustrate, habitation module 1 should be sufficiently lightweight that it may be lifted via helicopter, hauled by a small trailer, or transported in a truck bed. Habitation module 1 is designed to be easily attached to and detached from any of the portable platforms (e.g., helicopter, small or large trailer, truck bed) described herein through the use of turnbuckles, bolts, hooks, or other similar equipment.

Figure 2:
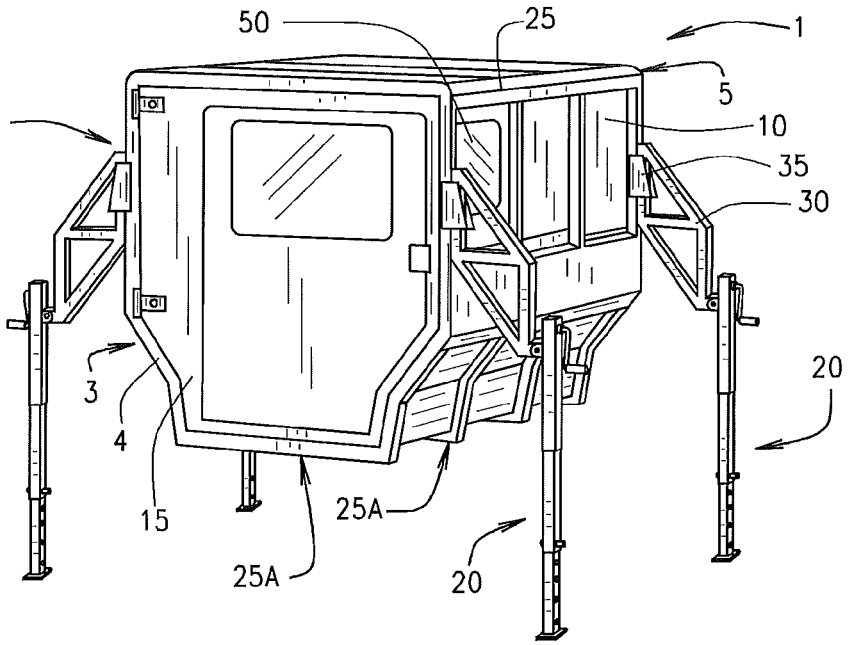
FIG. 2 illustrates a perspective view of the habitation module of FIG. 1 and attachable height-adjustable legs associated therewith.

FIG. 2 illustrates one embodiment of how habitation module 1 appears as set up for temporary habitation. Habitation module 1 preferably comprises a single habitable space for eating, sleeping, donning and doffing clothing, using equipment, etc. Habitation module 1 includes an upper portion 2 that is generally rectangular in shape, and it includes a lower portion 3 that may taper via an angled portion 4, such that lower portion 3 may fit into a bed of a pickup truck or small trailer as described herein and illustrated in FIG. 1C. Because of the tapering, the underside of lower portion 3 has less surface area than the top side of upper portion 2 of habitation module 1. As illustrated, the entire habitation module 1 preferably fits into a pickup truck bed such that it does not overhang the width of the pickup truck.

The exterior of habitation module 1 is broadly comprised of a rigid exoskeleton structure 5, insulated rigid panels 10, and end caps 15. Upon successful delivery to a site, height adjustable legs 20 may be releasably attached to habitation module 1 in a manner described herein below, so as to raise habitation module 1 off the ground to avoid moisture, animals, and other potential hazards to habitation module 1 and/or its inhabitants, or to merely remove the same transporting means which is used to deploy the module. In alternative embodiments, adjustable legs 20 are not attached to habitation module 1, and habitation module 1 rests either in its transportation means such as a pickup truck bed or small trailer, or habitation module 1 rests directly on a ground surface.

Exoskeleton structure 5 may serve as a structure to which rigid panels 10 may be attached to achieve a weatherproof enclosure, and exoskeleton structure 5 may be a structure to which various outfittings and attachments for use with habitation module 1 may be fastened. In the illustrated embodiment, exoskeleton structure 5 is comprised of a plurality of tubular structural metal frame members 25 to support habitation module 1. Exoskeleton structure 5 may be made of a durable, yet lightweight plastic as an alternative to the illustrated tubular metal frame members 25. Such an alternative, or yet another alternative may be utilized as is foreseeable to one skilled in the art. As illustrated in FIG. 2, frame members 25 may be positioned and located on the sides, roof, and bottom portions of habitable module 1 so as to collectively form exoskeleton structure 5. It is important to note that while FIG. 2 shows module 1 mounted on legs, it is specifically designed to rest its entire weight (occupied or not) on its lower horizontal surface bordered by horizontal frame members 25*a*.

As illustrated in FIG. 2, height adjustable legs 20 may be releasably attachable to habitation module 1. The height adjustable legs 20 may be releasably attachable such that habitation module 1 may be transportable with the legs detached from habitation module 1 and thus reduce the footprint of habitation module 1. By reducing its footprint, habitation module 1 may be transported more easily by the means described herein above (e.g., via helicopter, trailer, or truck bed).

Moreover, legs 20 may allow a user to remove habitation module 1 from the aforementioned transportation means. For example, a user may releasably attach the legs 20 to habitation module 1 using the equipment described herein below, adjust the height of the legs 20 slightly above a transportation platform such as a truck bed, remove the platform from underneath habitation module 1, and then lower or brace habitation module 1 via adjustable legs 20 via means either described herein or known in the art. Alternatively, legs 20 may not be included as part of habitation module 1.

In the illustrated embodiment, each leg 20 may be releasably attachable with a bracket member 30. Each bracket member 30 may further be mounted to habitation module 1 via a mounting member 35. Mounting member 35 allow habitation module 1 to be attached with a leg 20 as described above, or mounting member 35 may provide an attachment means for when habitation module 1 is placed in a pickup truck bed, whether the truck bed is large or small. Legs 20 are preferably height-adjustable such that if habitation module 1 is set up on an uneven surface when in use, habitation module 1, and resultantly inhabitants, may be on a level surface. In the illustrated embodiment, legs 20 are adjustable by means of adjustable jacks as known in the art. Alternative embodiments may use a plurality of detents to adjust legs 20 to various heights, and other foreseeable means for adjusting legs 20 are contemplated herein.

In the illustrated embodiment, habitation module 1 includes four legs 20, each leg 20 including its own bracket member 30 and mounting member 35 for selective attachment to habitation module 1. Legs 20 may be comprised of a sturdy but lightweight metal, for example aluminum. In alternative embodiments there may be fewer legs 20 releasably attached to habitation module, for example three legs 20 (not illustrated).

Exoskeleton structure 5 may serve as a structure to which rigid panels 10 may be attached. Rigid panels 10 may provide a weatherproof enclosure to protect inhabitants and equipment within habitation module 1 secure as well as at an appropriate temperature. Rigid panels 10 may be fastened to exoskeleton structure 5 via riveting, welding, or other fastening methods as may be known in the art.

Figure 3:
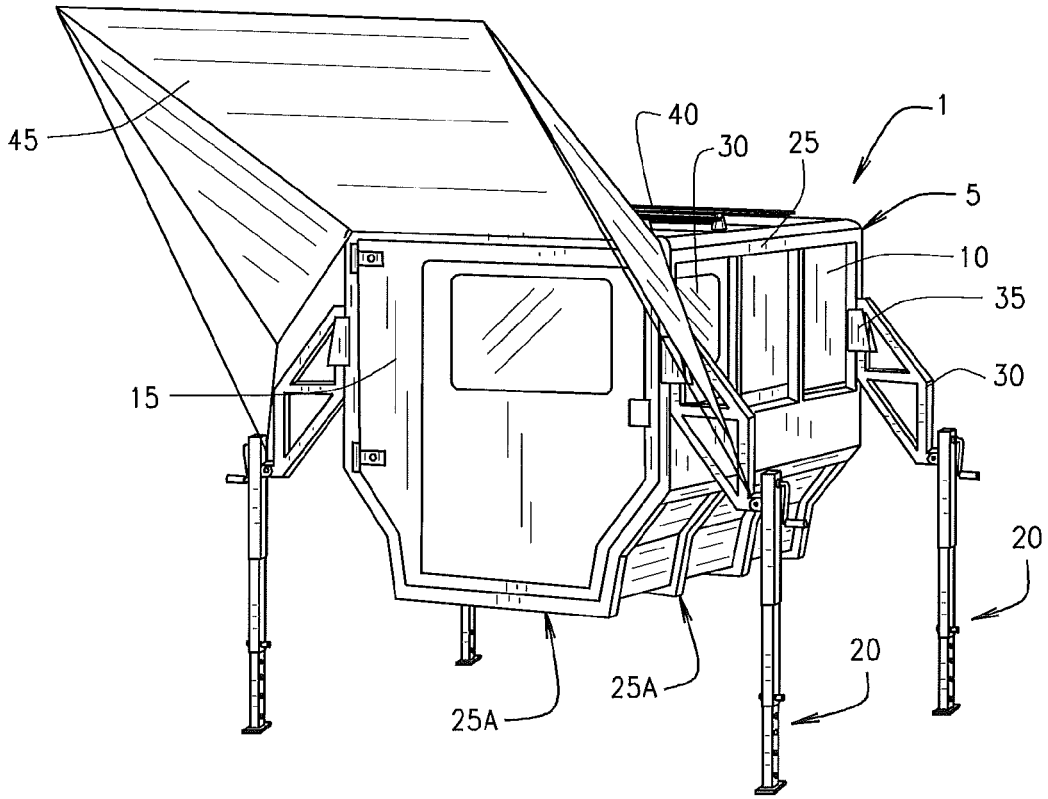
FIG. 3 illustrates a perspective view of the habitation module and associated attachable height-adjustable legs, and further including an awning and roof rack positioned and located thereon.

Exoskeleton structure 5 may include structure to which outfittings and attachments for use with habitation module 1 may be attached. For example, as illustrated in FIG. 3, habitation module 1 further comprises a roof rack 40 for releasably attaching luggage, bicycles, or other equipment thereto. Habitation module 1 illustrated in FIG. 2 further comprises an awning 45 selectively attached to habitation module 1. In yet other embodiments which are not illustrated herein, other attachments, for example other racks or containers, tables, water containers, or other equipment may be attached to habitation module 1 via various connection points 86 (see FIGS. 8, 10 and 12) for transporting or deploying the aforementioned equipment. Such holes or connection points may be customizable by a user, may be pre-drilled in anticipation of attachments to tubular frame members 25 of exoskeleton structure 5. In addition, exoskeleton structure 5 may be designed to accommodate more holes or connection points 86 for use as a user sees fit.

Figure 4:
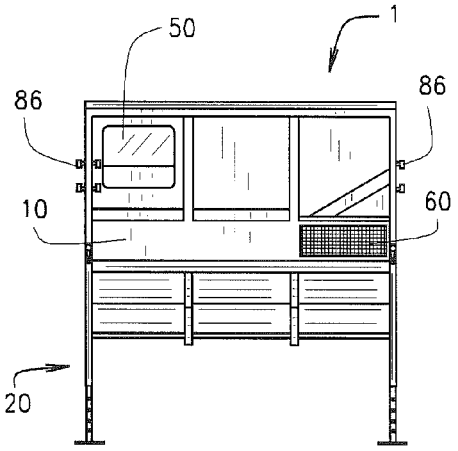
FIG. 4 is a left side elevation view of the habitation module of FIG. 2.
Figure 5:
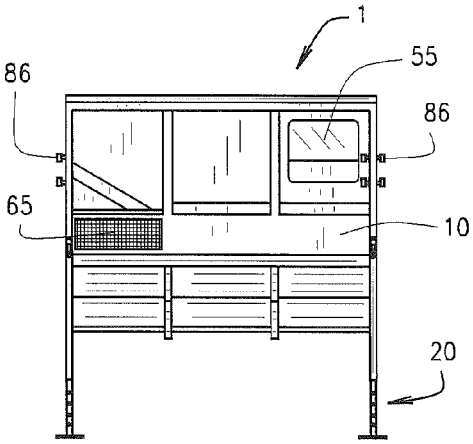
FIG. 5 is a right side elevation view of the habitation module of FIG. 2.

Rigid panels 10 may be manufactured as single sheets of composite material, such as aluminum or other lightweight metal such that they may receive and secure windows such as side window 50, illustrated in FIGS. 2-4. Side window 55, found on the opposite, side of habitation module 1 from side window 50, is illustrated in FIG. 5. It should be noted that alternative embodiments of illustrated habitation module 1 are herein envisioned wherein habitation module 1 comprises more or fewer windows than side windows 50, 55 illustrated in FIGS. 2-5. In yet another alternative embodiment, habitation module 1 may not include any windows. FIGS. 4 and 5 each illustrate one or more connection point 86 for attaching items thereto, mounting grid 60 illustrated in FIG. 4 and mounting grid 65 illustrated in FIG. 5. Mounting grids 60, 65 are attached to rigid panels 10 attached to both sides of habitation module 1. In the illustrated embodiments, mounting grids 60, 65 are substantially similarly sized and shaped to one another, and they may be used to attach equipment such as that described herein above. Grids 60, 65 may use means known in the art such as bungee cords, rope, or other means to fasten equipment thereto. Alternative embodiments are further envisioned wherein habitation module 1 comprises more or fewer mounting grids 60, 65 or wherein mounting grids 60, 65 are positioned and located in alternative locations on rigid panels 10 of habitation module 1.

Figure 6:
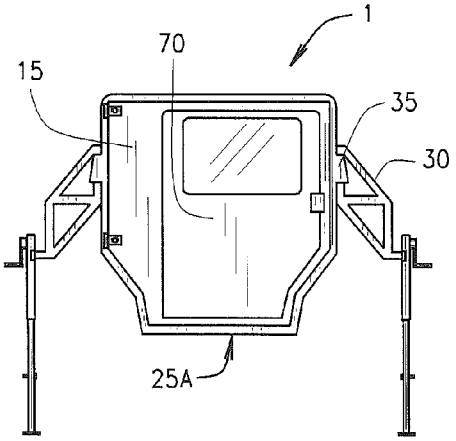
FIG. 6 is a front elevation view of an end cap of the habitation module of FIG. 2, wherein the end cap includes a single door.
Figure 7:
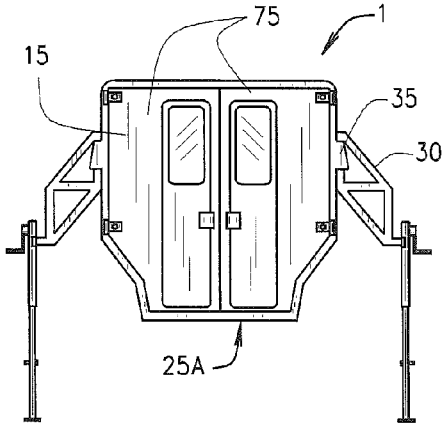
FIG. 7 illustrates an alternative embodiment of the end cap illustrated in FIG. 6, wherein the end cap includes double doors.

End caps 15, as illustrated in FIGS. 6 and 7 are elements separate from exoskeleton structure 5. End caps 15 comprise an integrated frame that includes a panel that is shaped and configured for various end cap configurations. End caps 15 may be positioned and located at the longitudinal end portions of habitation module 1. In FIG. 6, illustrated end cap 15 comprises a panel for receiving a single door 70, which is shown as hingedly attached to end cap 15. As illustrated in FIG. 7, end cap 15 may alternatively comprise double doors 75. Although not illustrated, other embodiments are herein envisioned wherein end cap 15 includes alternative opening panels such as doors or windows, or alternatively it comprises fixed panels with no openings, or some combination of the above-described embodiments. End caps 15 may further include integrated attach points or plates (not illustrated) for mounting useful equipment thereto. End cap 15 configuration may be selectable by a user to conform to his or her needs and preferred uses. End caps 15 may be interchangeable and their attach points may include hardware that is usable with exoskeleton structure 5 also.

Various embodiments of the interior of habitation module 1 are illustrated in FIGS. 8-12. The interior of habitation module 1 is comprised of an endoskeleton or useful interior storage structure 80 that is attached to the inside walls and ceiling of rigid panels 10 associated with exoskeleton structure 5. Useful interior storage structure 80 may be designed to provide attachment points 86 for interior outfitting of habitation module 1, such as integrated handholds or attachment of soft or hard sided storage units such as duffle bags, cases, or many types of other equipment. Such attach points 86 may include integrated periodic attach points for interior stowage items, wire handling for power cords and light cords, and/or attach points from which to hang items such as clothing, hammocks, or other useful interior fittings. The attachment points 86 within the interior of endoskeleton or interior storage structure 80 may be configured to be used with airline cargo track seat track cargo fittings, for example as shown on the Ancra International website of Azusa, Calif. 91702. Alternatively, the fittings may be custom made. Other fittings as known or foreseeable in the art may alternatively be used within interior storage structure 80.

Additionally, as illustrated in FIGS. 8-12, endoskeleton structure 80 may have attached thereto modular panels 85 which are positioned and located at various heights and angles to provide different storage and user configurations. Endoskeleton structure 80 may be made up of metal or wood and are structural only in as much as interior outfitting as chosen by a user requires. Endoskeleton structure 80 may be attached and/or deployed in the same spacing as found in exoskeleton structure 5.

Various adjustable modular furnishing panels 85 serve multiple functions on the interior of the module. For example modular furnishing panels 85 may serve as sleeping and/or sitting platforms, lids or covers for below deck storage areas, or work or stowage surfaces. Modular furnishing panels 85 are useful on both sides, with one side likely but not required to be upholstered such that it may be comfortable when used for sleeping or sitting. An un-upholstered side may include attach points or holes provided to attach and or stow useful outfitting for the module's usage. The panels 85 may be arranged in many configurations, some of which are embodied in the illustrations described herein.

Figure 8:
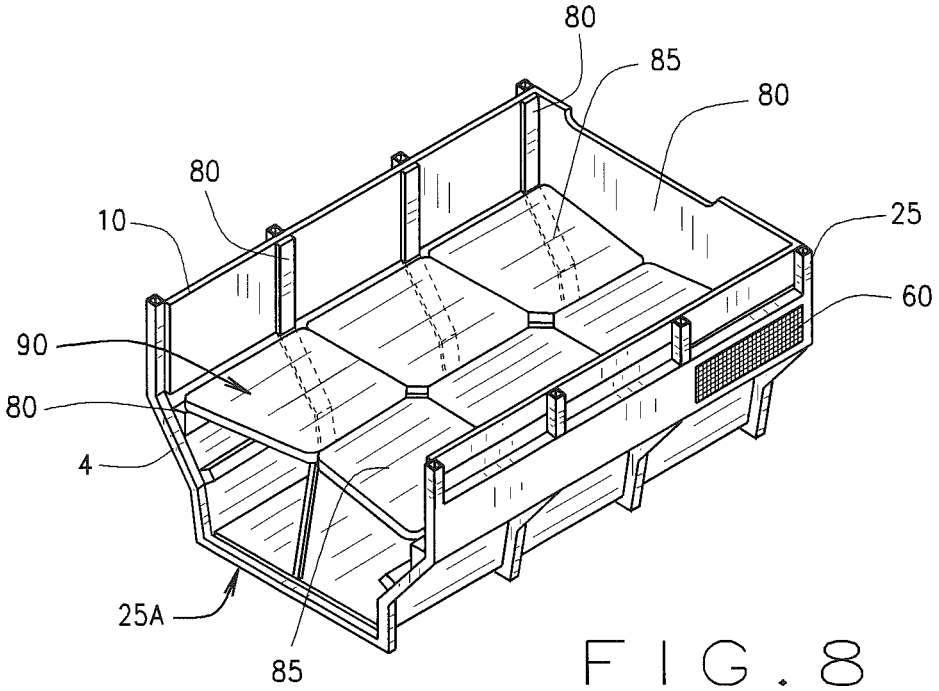
FIG. 8 is a perspective view of a cross-section of the habitation module, wherein the interior of the habitation module is in a bed configuration.
Figure 9:
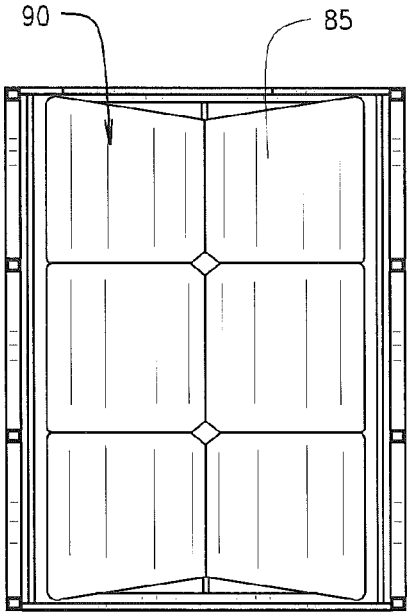
FIG. 9 is a top plan view of a cross-section of the interior of the habitation module in a bed configuration.

FIG. 8 illustrates a cross-sectional view of the interior of habitation module 1 in a bed configuration, and FIG. 9 illustrates a plan view of the same. As can be seen, in that configuration, modular furnishing panels 85 are hingedly connected to the interior walls of habitation module 1 such that they may be folded down to collectively form a sleeping area, or bed 90. In the embodiments illustrated in FIGS. 8 and 9, habitation module 1 includes six modular furnishing panels 85, though other alternatives wherein more or fewer panels 85 are used to form a bed are contemplated herein. Bed 90 may be of a size that can comfortably allow two to sleep thereon.

Figure 10:
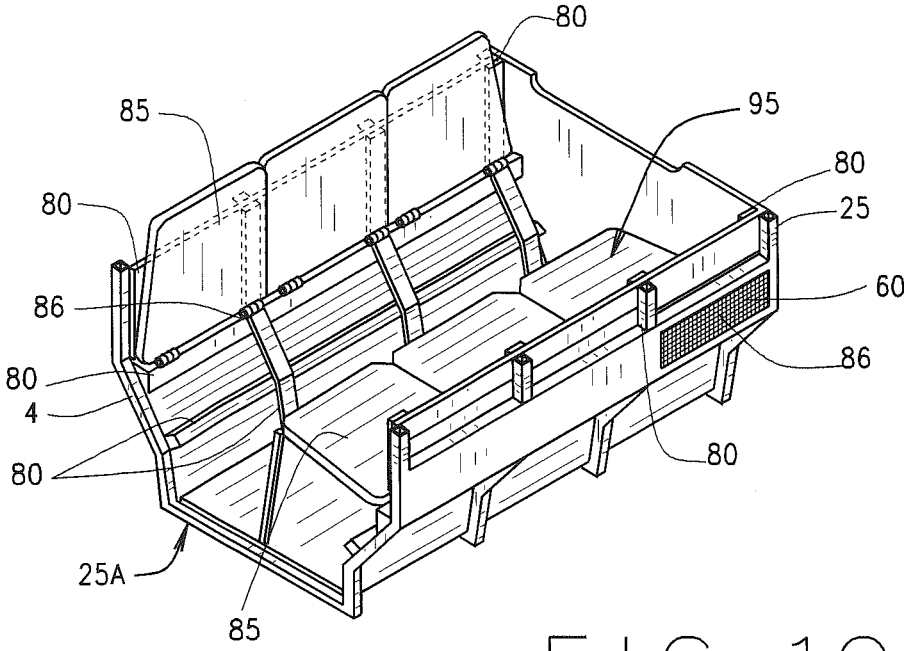
FIG. 10 is a perspective view of a cross-section of the habitation module, wherein the interior of the habitation module is in a seating configuration.
Figure 11:
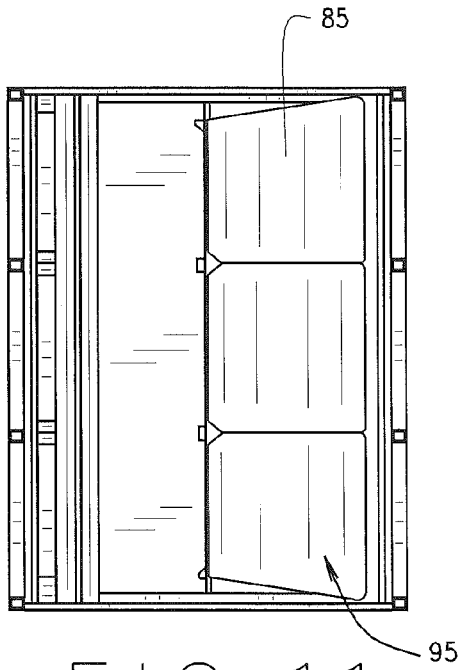
FIG. 11 is a top plan view of a cross-section of the interior of the habitation module in a seating configuration.

As illustrated in FIGS. 10 and 11, if a row of abutting modular furnishing panels 85 are folded upwards via their hinged connection to the interior of habitation module 1, panels 85 remaining in the down position form a row of seating 95. In the embodiment illustrated in FIGS. 10 and 11, the row of seating 95 comprises three furnishing panels 85, though alternative embodiments including more or fewer panels 85 are considered herein. It should also be noted that furnishing panels 85 from either side of the interior of habitation module 1 may be turned upwards to form a row of seating 95. Row of seating 95 may be used as a location for performing work functions and may also be used as space for one to sleep thereon. Other uses are contemplated herein. When modular furnishing panels 85 are in either the bed 90 configuration or the row of seating 95 configuration, equipment may be stowed under bed 90 or a row of seating 95.

Figure 12:
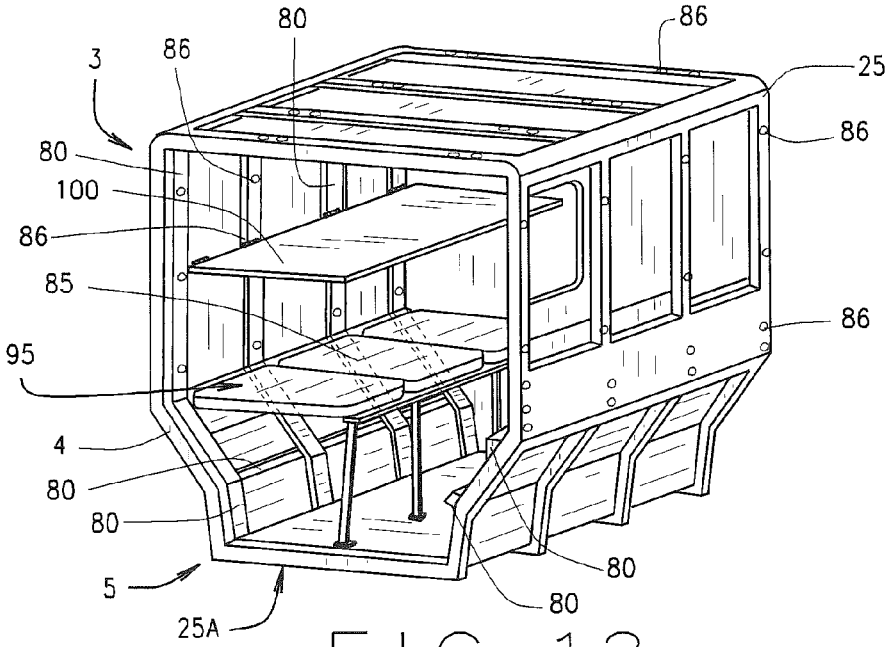
FIG. 12 is a perspective view of the habitation module, wherein the interior of the habitation module is in a bunk bed configuration.

FIG. 12 illustrates a separate embodiment than those described thus far. In that illustrated embodiment, modular panels 85 may be in row of seating 95 configuration. An upper bunk panel 100 is also hingedly connected to the interior of habitation module 1, and positioned and located above row of seating 95. Upper bunk panel 100, when in its down position (illustrated in FIG. 12), may serve as a bed for a child or adult. In alternative embodiments, upper bunk panel 100 may be positioned above bed 90 or it may be positioned on the opposite side of row of seating 95. In yet another alternative embodiment, habitation module 1 may include an additional upper bunk panel 100 (not illustrated). In the alternative embodiment wherein habitation module 1 includes two upper bunk panels 100, when bed 90 is also configured below the two upper bunk panels 100, habitation module may comfortably sleep two adults on bed 90 and two children, one on each of the upper bunk panels 100. In yet another alternative embodiment (not illustrated), if all furnishing panels 85 were turned upwards, habitation module 1 would be configured to store a great deal of equipment therein. In this embodiment, the interior of habitation module 1 may be referred to as a storage pod.

Figure 13:
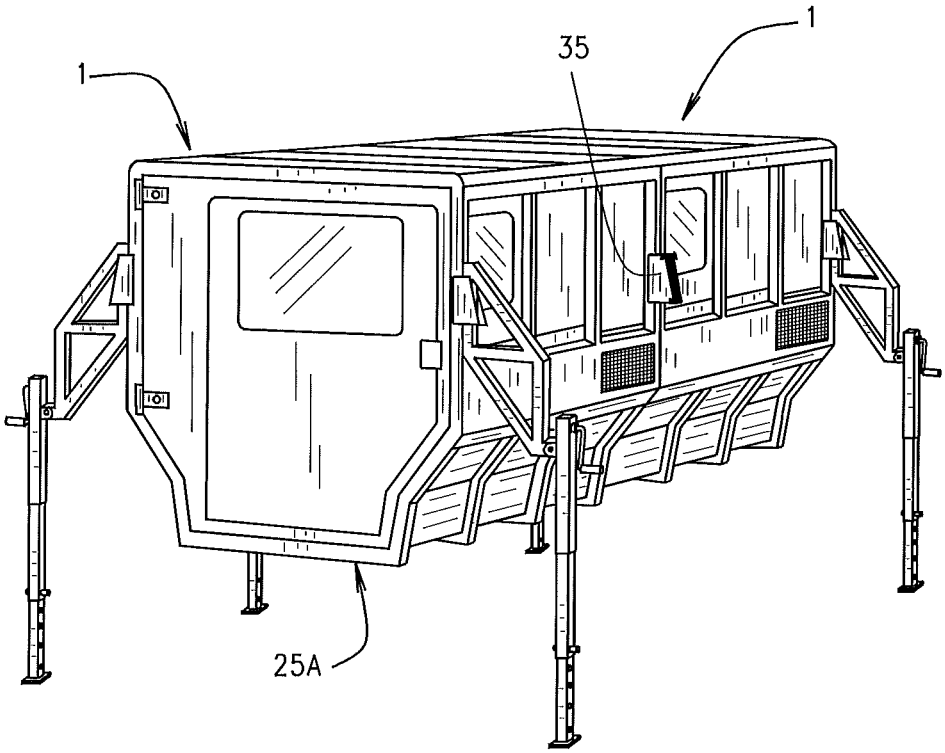
FIG. 13 is a perspective view of an alternative embodiment of the present invention, wherein two habitation modules have been attached to one another.

As illustrated in FIG. 13, habitation module 1 may be modular such that it may be attached to one or more additional habitation modules 1. In the illustrated embodiment, two habitation modules 1 are attached at the position and location where end caps 15 would be placed in the other illustrated habitation modules 1 described and illustrated herein. Alternatively, multiple habitation modules 1 may be attached side by side. Preferably when multiple habitation modules 1 are attached they are bolted to one another via adjacent mounting members 35. Other means of fastening adjacent habitation modules 1 are further contemplated herein. Embodiments are further envisioned wherein a bathroom or kitchen-style habitation module 1 is attached to a separate habitation module 1 to create a larger unit. It should be noted also that more than two habitation modules 1 may be attached to one another. The embodiment attaching multiple habitation modules 1 may be useful in a scenario such as a government deployment where it may be desired to have a habitation module 1 as a seated office and a separate but attached habitation module 1 as a contiguous support unit filled with electronics or other useful supplies.

Figure 14:
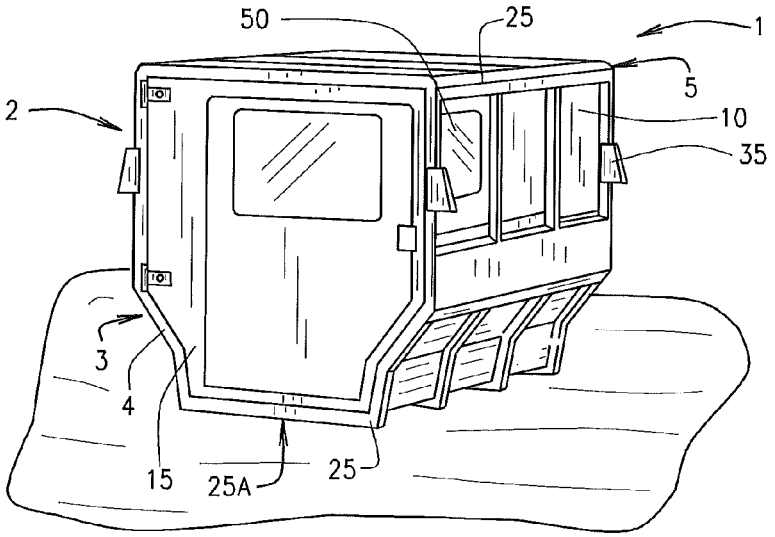
FIG. 14 is a perspective view of an alternative embodiment of the present invention wherein the habitation module is positioned directly on a relatively flat surface.
Figure 15:
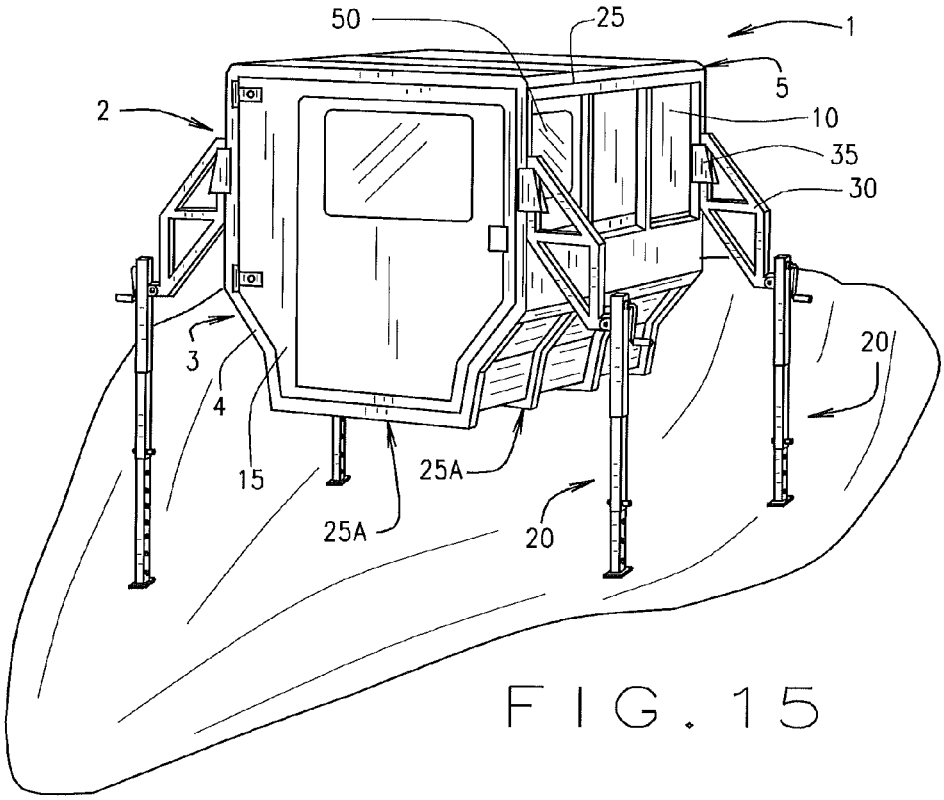
FIG. 15 is a perspective view of an alternative embodiment of the present invention wherein the habitation module is positioned on an uneven surface, and its associated height-adjustable legs are adjusted to keep the habitation module level.

FIG. 14 shows a single habitation module 1 resting on the ground and is therefore self-standing. It is understood that when located on the ground or other ground level surface such as tarmac, roadways, parking lots, and the like, it is likely that legs such as legs 20 will not be needed. Further no truck, trailer, or other support means is needed for habitation module 1. However, if the ground surface on which the module is resting is uneven, rocky, or slanted, legs 20 may be extended to be in ground contact to stabilize the habitation module 1 (or plurality of habitation modules 1 that are bolted together as described herein above) rather than elevate habitation module 1 off the ground. As such, and as illustrated in FIG. 15, legs 20 may be for both lifting habitation module 1 off ground level and to stabilize habitation module 1 or a combination of lifting and stabilizing habitation module 1. When legs 20 are used to stabilize habitation module 1 on uneven, rocky, or slanted ground surface, one may adjust the height of legs 20 in the manner described herein above and as illustrated in FIG. 15 to be of varying heights, the varying heights being adjusted and selected in order to try to keep habitation module 1 level despite being on a non-level surface.

The description of the various embodiments is to be construed as exemplary only and does not describe every possible instance of the inventive subject matter. Numerous alternatives can be implemented, using combinations of current or future technologies, which would still fall within the scope of the claims. The following detailed description is, therefore, not to be taken in a limiting sense, and the scope of the inventive subject matter is defined only by the appended claims.

The examples provided above are not intended to be an exhaustive explanation of each possible operation of the systems and methods described herein, and the various embodiments are not limited to any example described above.

Although an overview of the inventive subject matter has been described with reference to specific example embodiments, various modifications and changes may be made to these embodiments without departing from the broader spirit and scope of inventive subject matter. Such embodiments of the inventive subject matter may be referred to herein, individually or collectively, by the term "invention" merely for convenience and without intending to voluntarily limit the scope of this application to any single invention or inventive concept if more than one is, in fact, disclosed.

As is evident from the foregoing description, certain aspects of the inventive subject matter are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the inventive subject matter. Therefore, it is manifestly intended that this inventive subject matter be limited only by the following claims and equivalents thereof.

What is claimed is:

1. A habitation module, said habitation module comprising:

an exoskeleton structure comprising a plurality of substantially rigid tubular structural frame members disposed on a first side portion, a second side portion, a roof portion, and a bottom portion of the habitation module;

a plurality of insulated rigid panels attached to an interior side of said exoskeleton structure on said first side portion, said second side portion, said roof portion, and said bottom portion of said habitation module;

an endoskeleton structure comprising a plurality of inner frame members interior of said exoskeleton structure and said plurality of insulated rigid panels, said endoskeleton structure secured to said exoskeleton structure; and at least one end cap positioned and located at a longitudinal end portion of said habitation module;

wherein said endoskeleton and said exoskeleton each have a plurality of connection points for attaching one or more attachments to an exterior and an interior of said habitation module.

2. The habitation module of claim 1 wherein the habitation module includes an upper portion and a lower portion, and wherein the upper portion tapers to become the lower portion, and wherein the lower portion is of a size suitable for being secured in the bed of a pickup truck between its side walls and wheel wells.

3. The habitation module of claim 1 wherein said connection points of the exoskeleton structure comprise members for attaching thereto one or more attachments.

4. The habitation module of claim 1 further comprising one or more modular furnishing panels removably coupled to said endoskeleton.

5. The habitation module of claim 4 wherein the habitation module further comprises at least one upper bunk panel hingedly connected to the endoskeleton.

6. The habitation module of claim 1 wherein the habitation module is attached to one or more additional habitation modules to form a larger contiguous habitation module.

7. The habitation module of claim 1 wherein the exoskeleton structure includes one or more legs attached thereto at one or more of said plurality of connection points, the one or more legs being adjustable in height and capable of supporting the habitation module above ground level.

8. The habitation module of claim 7 wherein the one or more height-adjustable legs are attachable with the habitation module via a bracket member removably attached to one or more of said plurality of connection points.

9. The habitation module of claim 1 wherein the habitation module includes an upper portion and a lower portion, said upper portion having a greater width than said lower portion, and wherein the upper portion tapers to become the lower portion, and wherein the lower portion is of a size suitable for being secured in the bed of a pickup truck between its side walls and wheel wells.

10. The habitation module of claim 1 wherein a plurality of inner frame members of the endoskeleton are located in an opposing relationship to a plurality of structural frame members of said exoskeleton.

11. The habitation module of claim 1 wherein said habitation module includes at least a first side, a second side and a top side, and wherein said connection points are disposed on said first side, said second side and said top side of both of said exoskeleton and said endoskeleton.

12. The habitation module of claim 11 wherein said top side of said exoskeleton structure comprises one or more of said connection points configured to attach a roof rack thereto.

13. The habitation module of claim 1 wherein said exoskeleton structure includes one or more zones to accommodate additional user-located connection points, wherein said user-located connection points comprise structure or holes for securing one or more attachments to said habitation module.

14. The habitation module of claim 1 wherein said plurality of connection points comprise structure or holes for securing one or more attachments to said habitation module.

15. A habitation module, said habitation module comprising:

an exoskeleton structure comprising a plurality of substantially rigid tubular structural frame members disposed on a first side portion, a second side portion, a roof portion, and a bottom portion of the habitation module;

a plurality of insulated rigid panels attached to an interior side of said exoskeleton structure;

an endoskeleton structure disposed interior said plurality of insulated panels and said exoskeleton structure, said endoskeleton secured against one of said plurality of insulated panels or said exoskeleton structure;

wherein said endoskeleton and said exoskeleton each have a plurality of connection points disposed thereon for attaching one or more attachments to an exterior surface and an interior surface of said habitation module;

one or more modular furnishing elements releasably attachable to said endoskeleton structure at one or more of said plurality of connection points;

an end cap positioned and located at each longitudinal end portion of said habitation module.

16. The habitation module of claim 15 wherein said modular furnishing elements being releasably attachable to said endoskeleton.

17. The habitation module of claim 16 wherein said one or more modular furnishing elements is one of a modular furnishing panel, a working surface, a monitor, an electrical chase, a handhold, a hammock, an outfitting, audio-visual equipment, or a storage container.

18. The habitation module of claim 15 wherein said one or more modular furnishing elements is one of a modular furnishing panel, a working surface, a monitor, an electrical chase, a handhold, a hammock, an outfitting, audio-visual equipment, or a storage container.

19. A habitation module, said habitation module comprising:

an exoskeleton structure comprising a plurality of substantially rigid tubular structural frame members disposed on a first side portion, a second side portion, a roof portion, and a bottom portion of the habitation module;

a plurality of insulated rigid panels attached to an interior side of said plurality of substantially rigid tubular structural frame members on said first side portion, said second side portion, said roof portion, and said bottom portion of said habitation module;

an endoskeleton structure comprising a plurality of inner frame members interior of said exoskeleton structure and said plurality of insulated rigid panels, said endoskeleton structure secured to said exoskeleton structure, and a plurality of inner frame members of the endoskeleton being disposed in an opposing relationship to one or more of said plurality of substantially rigid tubular structural frame members of said exoskeleton;

at least one end cap disposed at a longitudinal end portion of said habitation module and removably coupled to said exoskeleton; and wherein the habitation module includes an upper portion and a lower portion, said upper portion having a first width that is greater than a second width of said lower portion, and wherein the upper portion tapers to become the lower portion, and wherein the second width of the lower portion is less than a bed width of a pickup truck.

20. The habitation module of claim 19 wherein said endoskeleton and said exoskeleton each have a plurality of connection points for attaching one or more attachments to an exterior and an interior of said habitation module.

* * * * *